US010197304B2

(12) United States Patent
Havard, Jr. et al.

(10) Patent No.: US 10,197,304 B2
(45) Date of Patent: Feb. 5, 2019

(54) TANDEM COMPRESSOR DISCHARGE PRESSURE AND TEMPERATURE CONTROL LOGIC

(71) Applicant: Lennox Industries Inc., Richardson, TX (US)

(72) Inventors: Harold Gene Havard, Jr., Carrollton, TX (US); Rosa Maria Leal, Irving, TX (US); Darko Hadzidedic, Plano, TX (US); Jimmie Lee Curry, Allen, TX (US); Anuradha Sundararajan, Allen, TX (US); Der-Kai Hung, Dallas, TX (US); William Clay Toombs, Jr., Carrollton, TX (US)

(73) Assignee: Lennox Industries Inc., Richardson, TX (US)

( * ) Notice: Subject to any disclaimer, the term of this patent is extended or adjusted under 35 U.S.C. 154(b) by 300 days.

(21) Appl. No.: 14/720,049

(22) Filed: May 22, 2015

(65) Prior Publication Data

US 2015/0338133 A1 Nov. 26, 2015

Related U.S. Application Data

(60) Provisional application No. 62/002,616, filed on May 23, 2014.

(51) Int. Cl.
*F25B 7/00* (2006.01)
*F24F 11/30* (2018.01)
(Continued)

(52) U.S. Cl.
CPC ..... *F25B 7/00* (2013.01); *F24F 11/001* (2013.01); *F24F 11/30* (2018.01); *F25B 49/005* (2013.01);
(Continued)

(58) Field of Classification Search
CPC ..... F25B 2500/07
(Continued)

(56) References Cited

U.S. PATENT DOCUMENTS 4,152,902 A * 5/1979 Lush ..... F04C 28/02 236/1 E
4,184,341 A * 1/1980 Friedman ..... F25B 5/02 236/1 EA
(Continued)

FOREIGN PATENT DOCUMENTS

GB 2512215 A * 9/2014 ..... B08B 15/00

*Primary Examiner* — Len Tran
*Assistant Examiner* — Jenna M Hopkins
(74) *Attorney, Agent, or Firm* — Baker Botts L.L.P.

(57) ABSTRACT

An HVAC system, comprising a plurality of sensors, a tandem compressor comprising a first compressor and a second compressor, and a controller communicatively coupled to the plurality of sensors and the tandem compressor. The controller may determine a first interruption of power to the tandem compressor and identify a sensor corresponding to the first interruption of power. The controller is further operable to determine that the first interruption of power was caused at least in part by the refrigerant associated with the first compressor exceeding a tolerance condition. The controller may also reconfigure the tandem compressor, wherein on or off settings of the first compressor and the second compressor are determined based on a required load operation of the tandem compressor and the determination that the first interruption of power was caused at least in part by the refrigerant associated with the first compressor exceeding the tolerance condition.

20 Claims, 3 Drawing Sheets

(51) Int. Cl.

| | |
|---|---|
| ***F24F 11/00*** | (2018.01) |
| ***F25B 49/00*** | (2006.01) |
| ***F25B 49/02*** | (2006.01) |
| *F24F 11/85* | (2018.01) |
| *F24F 11/32* | (2018.01) |
| *F24F 110/00* | (2018.01) |

(52) U.S. Cl.
CPC ..... *F25B 49/022* (2013.01); *F24F 11/32* (2018.01); *F24F 11/85* (2018.01); *F24F 2011/0052* (2013.01); *F24F 2011/0083* (2013.01); *F24F 2110/00* (2018.01); *F25B 2400/075* (2013.01); *F25B 2600/024* (2013.01); *F25B 2600/0251* (2013.01); *F25B 2700/151* (2013.01); *F25B 2700/1931* (2013.01); *F25B 2700/21152* (2013.01)

(58) Field of Classification Search
USPC ..... 62/175
See application file for complete search history.

(56) References Cited

U.S. PATENT DOCUMENTS 4,301,660 A * 11/1981 Mueller ..... F25B 49/02 62/126
4,614,089 A * 9/1986 Dorsey ..... F25B 49/022 236/1 EA
4,653,285 A * 3/1987 Pohl ..... F25B 49/025 318/729
4,748,820 A * 6/1988 Shaw ..... F25B 1/10 62/175
4,829,779 A * 5/1989 Munson ..... F24F 11/0009 236/51
5,050,397 A * 9/1991 Sugiyama ..... F25B 13/00 62/158
5,076,067 A * 12/1991 Prenger ..... F04C 28/28 417/32
5,123,256 A * 6/1992 Oltman ..... F25B 49/022 307/39
5,209,076 A * 5/1993 Kauffman ..... F25B 49/005 62/126
6,047,557 A * 4/2000 Pham ..... A47F 3/04 236/1 EA
6,647,735 B2 * 11/2003 Street ..... F25B 49/02 236/51
7,000,422 B2 * 2/2006 Street ..... F25B 49/02 236/51
7,137,265 B2 * 11/2006 Kim ..... F25B 31/004 62/192
7,722,331 B2 * 5/2010 Hirasawa ..... F04B 41/02 417/44.2
9,669,498 B2 * 6/2017 Pham ..... B23P 15/26
9,885,507 B2 * 2/2018 Pham ..... F25B 49/005
2003/0037555 A1 * 2/2003 Street ..... F25B 49/02 62/175
2004/0003606 A1 * 1/2004 So ..... F25B 49/022 62/158
2004/0003610 A1 * 1/2004 So ..... F25B 13/00 62/175
2005/0076659 A1 * 4/2005 Wallace ..... F25B 5/02 62/157
2005/0160761 A1 * 7/2005 Taras ..... F25B 1/10 62/510
2005/0196285 A1 * 9/2005 Jayanth ..... F04C 23/008 417/44.11
2005/0235660 A1 * 10/2005 Pham ..... F04C 28/00 62/126
2007/0157650 A1 * 7/2007 Takegami ..... F25B 13/00 62/230
2008/0041072 A1 * 2/2008 Seefeldt ..... F24D 3/12 62/117
2008/0209925 A1 * 9/2008 Pham ..... F25B 49/005 62/126
2009/0183519 A1 * 7/2009 Nishikawa ..... F25B 49/005 62/132
2009/0235678 A1 * 9/2009 Taras ..... F24F 3/153 62/115
2013/0104580 A1 * 5/2013 Choi ..... F25B 1/10 62/115
2013/0107401 A1 * 5/2013 Helt ..... H02H 7/09 361/33
2014/0262134 A1 * 9/2014 Arensmeier ..... F24D 19/1084 165/11.2
2015/0168036 A1 * 6/2015 Goel ..... F25B 49/02 62/56
2016/0047584 A1 * 2/2016 Bahel ..... F25B 49/025 62/115
2017/0241690 A1 * 8/2017 Groshek ..... F04C 18/0215
2017/0266769 A1 * 9/2017 Pham ..... F04C 28/00

* cited by examiner

TANDEM COMPRESSOR DISCHARGE PRESSURE AND TEMPERATURE CONTROL LOGIC

RELATED APPLICATION

This application claims benefit under 35 U.S.C. § 119(e) to U.S. Provisional Application Ser. No. 62/002,616, entitled "Tandem Compressor Discharge Pressure and Temperature Control Logic," filed May 23, 2014, the entire content of which is incorporated herein by reference.

TECHNICAL FIELD

This application is directed, in general, to heating, ventilation, and air conditioning systems (HVAC) and, more specifically, to tandem compressor discharge pressure and temperature control logic.

BACKGROUND

Some HVAC systems are implemented with two or more compressors configured for operation as tandem compressors within a tandem compressor group. The tandem compressors comprising a tandem compressor group may be incorporated into a single circuit of HVAC system components. Advantageously, tandem compressors may allow for more efficient HVAC system operation over a broad demand range. A tandem compressor HVAC system may, for example, efficiently meet a partial load demand by operating only one compressor from among the tandem compressor group to meet the partial load demand. The tandem compressor HVAC system may also provide for a greater full load capacity, as the multiple compressors within the tandem compressor group may be simultaneously operated to meet large demands on the HVAC system. Tandem compressors may share common refrigerant piping. Specifically, the suction pipe leg for each, respective, tandem compressor may diverge from a common suction pipe. Similarly, the discharge pipe leg for each, respective, tandem compressor may converge at a common discharge pipe.

SUMMARY

In one embodiment, an HVAC system comprises a plurality of sensors, a tandem compressor comprising a first compressor and a second compressor, and a controller communicatively coupled to the plurality of sensors and the tandem compressor. The controller may determine a first interruption of power to the tandem compressor and identify a sensor corresponding to the first interruption of power. The controller is further operable to determine that the first interruption of power was caused at least in part by the refrigerant associated with the first compressor exceeding a tolerance condition. The controller may also reconfigure the tandem compressor, wherein on or off settings of the first compressor and the second compressor are determined based on a required load operation of the tandem compressor and the determination that the first interruption of power was caused at least in part by the refrigerant associated with the first compressor exceeding the tolerance condition.

In one embodiment, a controller for operating an HVAC system comprises a memory and a processor communicatively coupled to the memory. The processor is operable to determine a first interruption of power to a tandem compressor. The tandem compressor may comprise a first compressor and a second compressor. The processor may be further operable to identify a sensor corresponding to the first interruption of power to the tandem compressor. The sensor may be one of a plurality of sensors. The processor may be operable to determine that the first interruption of power was caused at least in part by the refrigerant associated with the first compressor exceeding a tolerance condition. The processor may also be operable to reconfigure the tandem compressor. The processor may determine the on or off settings of the first compressor and the second compressor based on a required load operation of the tandem compressor and the determination that the first interruption of power was caused at least in part by the refrigerant associated with the first compressor exceeding the tolerance condition.

Certain embodiments of the present disclosure may provide one or more technical advantages. For example, if one of the compressors creates an over-pressure condition or an over-heated condition, then it needs to be powered off to avoid damage or failure of the compressor. By determining which compressor caused the issue and turning off just that one compressor, rather than turning off all of the compressors of the tandem compressor, the system may continue operation and satisfying a temperature demand on the HVAC system while ensuring compressors operate safely and without risk of failure.

Certain embodiments of the disclosure may include none, some, or all of the above technical advantages. One or more other technical advantages may be readily apparent to one skilled in the art from the figures, descriptions, and claims included herein. Moreover, while specific advantages have been enumerated above, various embodiments may include all, some, or none of the enumerated advantages.

BRIEF DESCRIPTION OF THE DRAWINGS

For a more complete understanding of the present invention and the advantages thereof, reference is now made to the following Detailed Description taken in conjunction with the accompanying drawings, in which.

DETAILED DESCRIPTION

A common means for monitoring operation and performance of a compressor may utilize sensed pressures of refrigerant entering into, and discharged from, a compressor. Pressure switches and temperature switches are often used to detect the occurrence of over-pressurization and over-heating of refrigerant within HVAC systems, respectively. Over-pressurization of refrigerant within an HVAC system may indicate that a compressor is operating outside of its optimal operating range, or may be failing. Pressure switches and temperature switches may interrupt power to a compressor upon detection of an over-pressure condition or an over-heated condition. Unfortunately, in HVAC systems provided with tandem compressors, pressure switches and temperature switches may be incapable of identifying a specific failing compressor from among the tandem compressor group. The switches may sense a refrigerant pressure or temperature corresponding to all of the tandem compressors, rather than a refrigerant pressure or temperature corresponding to operation of a specific tandem compressor, since the refrigerant pressures and temperatures may equalize through the common piping. Therefore, when an over-pressure or over-heated condition is detected in an HVAC system provided with tandem compressors, power to all of tandem compressors within the tandem compressor group may be interrupted since the specific compressor causing the over-pressure or over-heated condition is not identifiable by the pressure or temperature switch.

In these situations, it is helpful to identify which individual compressor is causing the over-pressure or over-heated condition. A controller may turn off all of the individual compressors of the tandem compressor and sequentially turn on each individual compressor one at a time. If an over-pressure or over-heated condition is determined while one individual compressor is powered on, then it may be determined that this individual compressor caused the power interruption to the tandem compressor. In response to this determination, the controller may power off the individual compressor responsible for the power interruption and reconfigure the tandem compressor such that it can at least partially meet the required load operation to satisfy the temperature demand associated with the HVAC system. In this way, the system prevents or lessens the risk of damage to the individual compressor with an over-pressure or over-heated condition by powering it off, but allows the HVAC system continue to operation in a safe way by powering on the safe compressors. Rather than keeping all of the individual compressors of the tandem compressor powered off until the individual compressor responsible for the power interruption is repaired, the HVAC system can continue to operate and at least partially work towards meeting the demand on the HVAC system.

Figure 1:
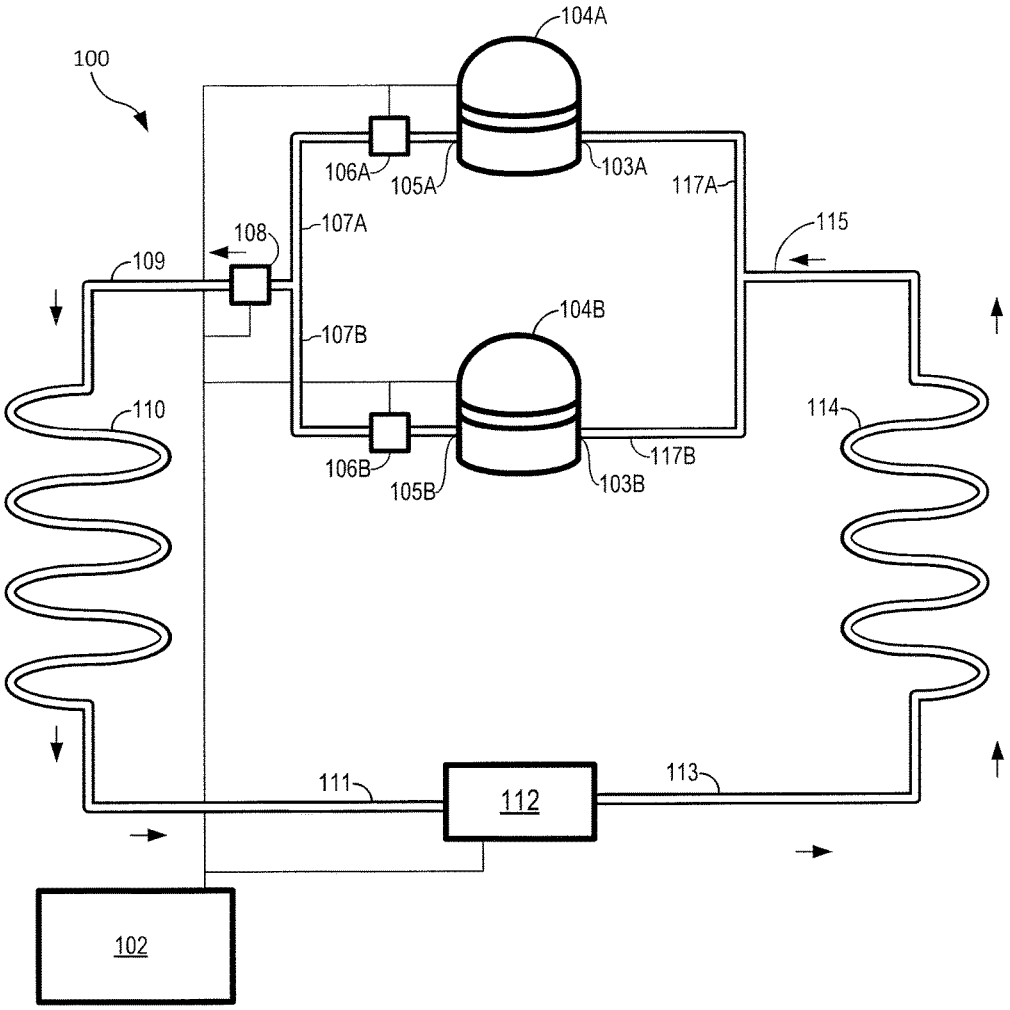
FIG. 1 illustrates a block diagram of an example HVAC system for providing tandem compressor discharge pressure and temperature control.

Referring to FIG. 1, an embodiment of HVAC system 100 for providing conditioned supply air to a space is shown. According to the embodiment shown, the HVAC system 100 may include controller 102, compressor 104A, compressor 104B, temperature sensor 106A, temperature sensor 106B, pressure switch 108, condenser 110, metering device 112, evaporator 114, and the refrigerant piping arrangement shown. In certain embodiments, HVAC system 100 may be provided with additional or fewer components than those shown in FIG. 1. For example, in certain embodiments, HVAC system 100 may include: additional compressors 104; additional condensers 110 and/or evaporators 114, such as in a Variable Refrigerant Flow (VRF) system; additional metering devices 112; additional or fewer temperature sensors 106, and/or additional pressure switches 108, and the like. Additionally, in some embodiments, the HVAC system 100 may include different components than as shown in the embodiment of FIG. 1. For example, HVAC system 100 may include one or more valves, such as check valves, reversing valves, three way valves, four way valves, and the like for controlling the direction and/or rate of refrigerant flow within HVAC system 100. Those of ordinary skill in the art will appreciate that corresponding changes to the piping arrangement of HVAC system 100 may be provided to accommodate the features, functions, and components of such embodiments of HVAC system 100.

As shown in FIG. 1, in an embodiment, HVAC system 100 may be provided with a piping arrangement that includes discharge pipe leg 107A, discharge pipe leg 107B, common discharge pipe 109, high pressure liquid pipe 111, low pressure liquid pipe 113, common suction pipe 115, suction pipe leg 117A, and suction pipe leg 117B. In some embodiments, HVAC system 100 may be provided with a piping arrangement different from that shown in FIG. 1, configured to accommodate the specific features, functions, and components of the particular HVAC system 100 embodiment.

According to the embodiment shown in FIG. 1, HVAC system 100 piping may route HVAC system 100 refrigerant in a circuit through HVAC system 100 components. Compressors 104A-B may each receive low pressure gaseous refrigerant from evaporator 114 via common suction pipe 115 and respective suction legs 117A-B. Compressors 104A-B may compress the received refrigerant and discharge high pressure, high temperature gaseous refrigerant to condenser 110 via respective discharge legs 107A-B and via common discharge pipe 109. High pressure, high temperature liquid refrigerant may exit condenser 110 and be routed to metering device 112 via high pressure liquid pipe 111. Low pressure liquid refrigerant may be routed from metering device 112 to evaporator 114 via low pressure liquid pipe 113, completing the refrigerant flow circuit through HVAC system 100.

HVAC system 100 may be configured for use with refrigerant as part of vapor compression cycle operation. HVAC system 100 may provide heating, ventilation, or cooling supply air to a space. HVAC system 100 may be used in residential or commercial buildings, and in refrigeration. HVAC system 100 is not necessarily capable of all of heating, ventilation, and air conditioning operations. In an embodiment, HVAC system 100 may be a heat pump unit, a heating only unit, a cooling only unit, a VRF unit, or the like. Additionally, HVAC system 100 may be a single stage or multi-stage unit. HVAC system 100 may be configured to operate in response to both full load and partial load demands. According to the embodiment shown, full load demand may require operation of both compressors 104A and 104B while partial load demand may require operation of only one compressor 104A or 104B.

HVAC system 100 may include controller 102 for controlling, monitoring, protecting, and/or configuring HVAC system 100 components. Controller 102 may be implemented with control logic for selectively energizing or de-energizing one or more HVAC system 100 components in response to demands on HVAC system 100, user input, data received from sensors, and the like. Controller 102 may be connected to HVAC system 100 components via wired or wireless connections.

In an embodiment, controller 102 may be configured to provide status information indicating the operation and performance of HVAC system 100 components. For example, controller 102 may alert users of operational statuses, conditions, and component failures of HVAC system 100. In such embodiments, controller 102 may comprise a display screen, one or more LEDs, a speaker, or some other similar device capable of indicating status information to a user of HVAC system 100. Additionally, controller 102 may be configured to transmit status information to one or more devices or systems remote to HVAC system 100. The component, or components, associated with a detected failure condition within HVAC system 100 may be identified on controller 102 display, for example. Controller 102 may raise a system alarm by displaying an alarm code on a screen of controller 102. If, in an embodiment, controller 102 is connected to a central energy or building management system, controller 102 may also transmit an alarm code to that system. Controller 102 may continue to operate HVAC system 100 during the system alarm, including providing heating or cooling to a conditioned space using HVAC system 100 components to which power has not been interrupted.

In an embodiment, controller 102 may be provided with one or more internal components configured to perform one or more of the functions of a memory, a processor, and/or an input/output (I/O) interface. Controller 102 memory may store computer executable instructions, operational parameters for system components, calibration equations, predefined tolerance values, or ranges, for HVAC system 100 operational conditions, and the like. Controller 102 processor may execute instructions stored within controller 102 memory. Controller 102 I/O interface may operably connect controller 102 to HVAC system 100 components such as compressors 104A-B, temperature sensors 106A-B, pressure switch 108, and/or metering device 112, as well as other components that may be provided.

Controller 102 may be implemented with logic for monitoring and/or reconfiguring operation of HVAC system 100 components. In an embodiment, controller 102 may receive data from one or more remote devices, such as from temperature sensors 106A-B and/or pressure switch 108. Controller 102 may receive sensed data indicating refrigerant temperatures or pressures at one or more locations within HVAC system 100. Additionally, controller 102 may receive data from one or more remote devices indicating status information. For example, controller 102 may receive status information indicating the position of a switch, such as the position of pressure switch 108 or whether compressors 104A-B are energized or de-energized. Compressors 104A-B are energized, for example, when they are turned on (e.g., powered on) and when there is electricity flowing through it that enables it to be turned on and compressor refrigerant. Compressors 104A-B are de-energized, for example when they are turned off (e.g., powered off) and when there is no electricity flowing through the compressor, preventing it from compressing refrigerant. The data received by controller 102 may comprise signals from one or more remote devices. Controller 102 may receive one or more signals directly from one or more remote devices. In some embodiments, controller 102 may receive one or more signals indirectly from one or more remote devices, such as through one or more intermediate devices. The one or more intermediate devices may comprise signal converters, processors, input/output interfaces, amplifiers, conditioning circuits, connectors, and the like.

In an embodiment, controller 102 may use data received from one or more sensors may be compared to one or more tolerance values stored within controller 102 memory. Controller 102 may reconfigure aspects of HVAC system 100 operation in response to the outcomes of such comparisons. For example, controller 102 may take one or more corrective actions in response to determining that a parameter value is out-of-tolerance including, perhaps, de-energizing one or more of the compressors 104A-B or generating an alert to indicate the status of one or more HVAC system 100 components.

As shown in FIG. 1, in an embodiment, HVAC system 100 may include compressors 104A-B, which may compress received refrigerant as part of a vapor compression cycle. Compressors 104A-B may be operated either independently or in concert to meet a demand on HVAC system 100. During operation, one or both of compressors 104A-B may discharge high pressure refrigerant which may be routed to condenser 110.

Compressors 104A and 104B may be compressors of any type known in the prior art, such as reciprocating compressors, scroll compressors, and the like. Compressors 104A and 104B may be single speed or variable speed compressors. Compressors 104A-B may operably couple to controller 102 via wired, or wireless, connections. Controller 102 may selectively energize or de-energize either or both of the compressors 104A-B in response to demands on HVAC system 100 as well as in response to data received by controller 102 from one or more remote sensing devices.

As shown in the embodiment of FIG. 1, compressors 104A-B may be tandem compressors within a tandem compressor group. Compressors 104A-B may both be part of a single circuit of components configured for vapor compression cycle operation. In some embodiments, HVAC system 100 may have a "merged" piping configuration, whereby both of compressors 104A-B are in fluid communication with common piping sections. Compressors 104A-B may receive refrigerant via suction pipe legs 117A-B, respectively. Suction pipe legs 117A-B may couple with common suction pipe 115, forming refrigerant flow paths between common suction pipe 115 and respective compressors 104A-B. Suction pipe legs 107A-B may couple to compressors 104A-B, respectively, at suction ports 103A-B, respectively. HVAC system 100 refrigerant received at suction ports 103A-B may, therefore, be at substantially the same temperature and pressure.

The compressors 104A-B may discharge refrigerant into the discharge pipe legs 107A-B, respectively. The discharge pipe legs 107A-B may couple to the compressors 104A-B at the discharge ports 105A-B, respectively. The discharge pipe legs 107A-B may couple with common discharge pipe 109, forming a single refrigerant flow path routing HVAC system 100 refrigerant to condenser 110.

Referring to FIG. 1, in an embodiment, HVAC system 100 may include temperature sensors 106A-B. Temperature sensors 106A-B may directly sense, calculate, approximate, or determine from sensed data, HVAC system 100 refrigerant temperature within the portion of refrigerant piping to which temperature sensors 106A-B are affixed. Temperature sensors 106A-B may be operably connected to controller 102 via wired or wireless connections. Temperature sensors 106A-B may transmit signals comprising sensed temperature data or component status data to controller 102.

In certain embodiments, temperature sensors 106A-B may transmit analog or pneumatic signals either directly, or indirectly, to controller 102. In such an embodiment, the signals transmitted by temperature sensors 106A-B may be converted to digital signals prior to use by controller 102. In some embodiments, temperature sensors 106A-B may transmit digital signals to controller 102. In such an embodiment, the digital signals transmitted by temperature sensors 106A-B may be processed prior to use by controller 102 to convert the signals to a different voltage, to remove interference from the circuits, to amplify the signals, or other similar forms of digital signal processing. In some embodiments, the signals of temperature sensors 106A-B may be transmitted to controller 102 directly or indirectly, such as through one or more intermediary devices.

Temperature sensors 106A-B may be configured to sense temperature data for HVAC system 100 refrigerant discharged from respective compressors 104A-B. In some embodiments, temperature sensors 106A-B may couple to discharge pipe legs 107A-B, respectively. Temperature sensors 106A-B may be coupled at locations on discharge pipe legs 107A-B, respectively, upstream of the respective couplings between discharge pipe legs 107A-B and common discharge pipe 109. Temperature sensor 106A may sense the temperature of HVAC system 100 refrigerant discharged from compressor 104A through discharge pipe leg 107A. Temperature sensor 106B may sense the temperature of HVAC system 100 refrigerant discharged from compressor 104B through discharge pipe leg 107B. In some embodiments, temperature sensors 106A-B may couple to respective suction pipe legs 117A-B for sensing HVAC system 100 refrigerant temperature received by respective compressors 104A-B.

Temperature sensors 106A-B may be temperature switches configured to actuate a switching mechanism between open and closed positions in response to sensed temperature data. Temperature sensors 106A-B may be temperature switches of any type comprising the prior art, such as bimetallic strip temperature switches, liquid filled temperature switches, and the like. In an embodiment, temperature sensors 106A-B may connect to controller 102 via wired or wireless connections to transmit to controller 102 one or more signals indicating the positions of respective temperature sensor 106A-B switching mechanisms.

Temperature sensors 106A-B may be configured to operate as "high temperature switches." Temperature sensors 106A-B may actuate a switching mechanism in response to sensing a refrigerant temperature above a defined set point. The set point may define a maximum allowable temperature of HVAC system 100 refrigerant discharged by compressors 104A-B. Detection of refrigerant within discharge pipe leg 107A above the set point temperature may indicate unsafe or faulty operation of compressor 104A. Temperature sensor 106A may be configured to operatively interrupt one or more power signals to de-energize compressor 104A in response to detection of refrigerant within discharge pipe leg 107A above the set point temperature. Similarly, detection of refrigerant within discharge pipe leg 107B above the set point may indicate unsafe or faulty operation of compressor 104B. Temperature sensor 106B may interrupt one or more power signals to de-energize compressor 104B in response to detection of refrigerant within discharge pipe leg 107A above the set point.

In certain embodiments, temperature sensors 106A-B may be temperature switches configured for normally closed operation. Normally closed temperature switches may remain in the closed position unless and until the sensed temperature of refrigerant rises to above the set point. A normally closed temperature switch may open in response to a sensed temperature value above the set point. A normally closed temperature switch may interrupt one or more power signals when in the open position. In some embodiments, temperature sensors 106A-B may be normally open temperature switches and remain in the open position unless and until the sensed temperature of refrigerant rises to above the set point. A normally open temperature switch may close in response to a sensed temperature value above the set point to interrupt one or more power signals. In some embodiments, temperature sensors 106A-B may be further configured to return to the normal switch position in response to sensed temperature data falling to below a defined reset temperature. The reset temperature may be a preset temperature indicating that the one or more interrupted power signals may be restored, allowing for re-energizing of one or more compressors 104A-B.

In some embodiments, temperature sensors 106A-B may be thermistors. In further embodiments, temperature sensors 106A-B may be thermocouples, resistive temperature devices, infrared sensors, thermometers, or the like. In such embodiments, temperature sensors 106A-B may be configured to transmit one or more signals to controller 102 indicating the respective temperature data sensed by the temperature sensors 106A-B. Controller 102 may energize or de-energize compressors 104A-B in response to temperature data received from the temperature sensors 106A-B. For example, in an embodiment, controller 102 may compare temperature data received from temperature sensor 106A to a tolerance value stored in controller 102 memory, and may de-energize compressor 104A if the temperature data exceeds the tolerance value. Similarly, in an embodiment, controller 102 may compare temperature data received from temperature sensor 106B to a tolerance value stored in controller 102 memory, and may de-energize compressor 104B if the temperature data exceeds the tolerance value. Additionally, controller 102 may generate an alert in response to reception of temperature data from one or both of the temperature sensors 106A-B above the tolerance value.

Figure 2:
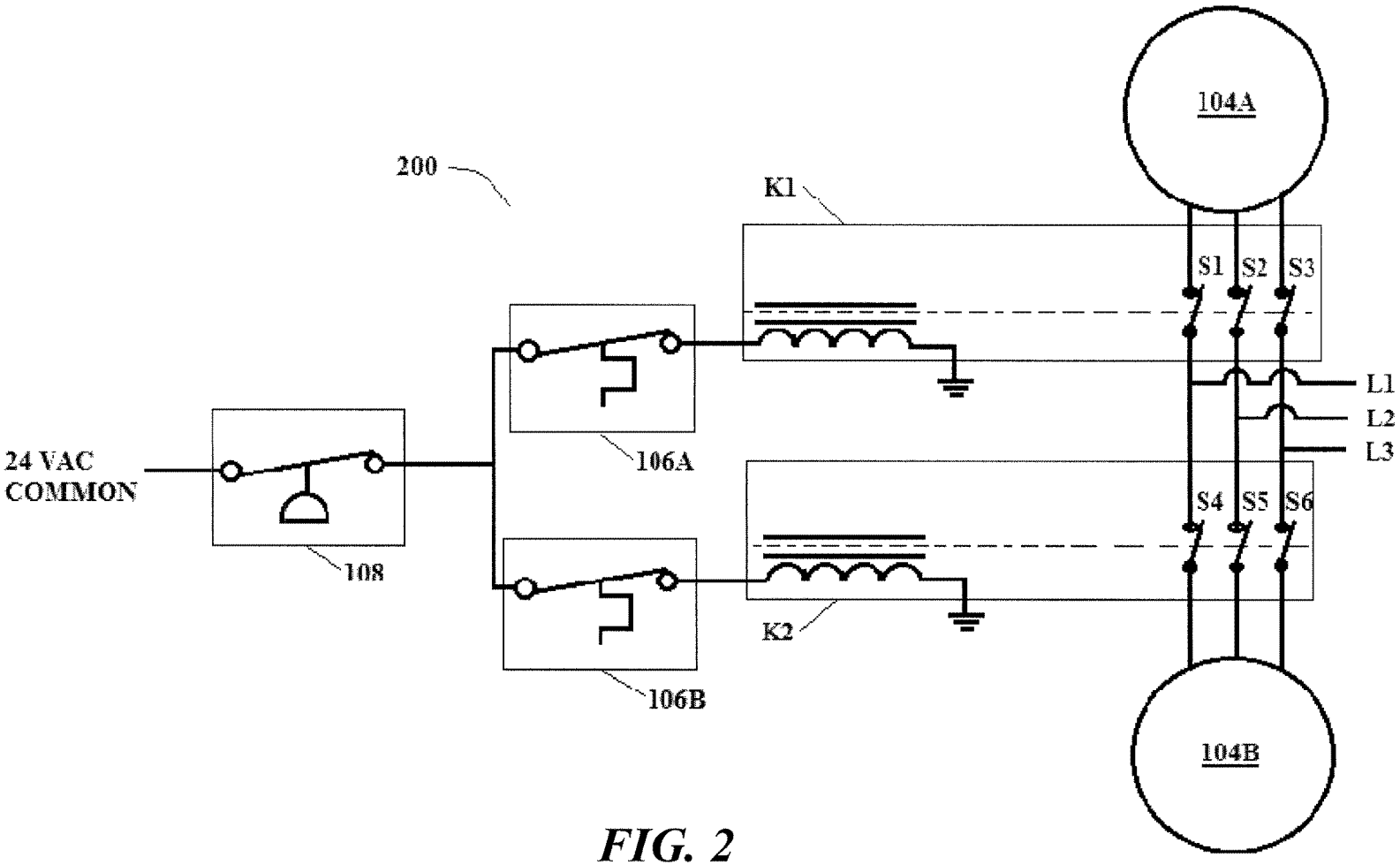
FIG. 2 illustrates a wiring diagram of an example power interrupter circuit.

FIG. 2 illustrates a wiring diagram of an example power interrupter circuit 200. The components and operation of power interrupter circuits are known to those of ordinary skill in the art and are, therefore, described briefly, herein. Further, power interrupter circuit 200 shown in FIG. 2 is provided for illustrative purposes, only, and is not intended to limit the scope of the apparatus and method described herein. Those of ordinary skill in the art will appreciate that a multitude of circuit configurations and components may be implemented within HVAC system 100 while still providing for the functions of temperature sensors 106A-B described herein and above, to be performed.

According to the embodiment of FIG. 2, temperature sensors 106A-B may be normally closed temperature switches. Temperature sensor 106A may electrically couple in series with a power source (24 VAC Common) and a contactor $K_1$ while temperature sensor 106B may electrically couple in series with the power source (24 VAC Common) and a contactor $K_2$. Temperature sensors 106A-B may be interposed between the power source (24 VAC Common) and the contactors $K_{1,\ 2}$, respectively. When energized, the contactor $K_1$ may cause one or more normally open power switches $S_{1\text{-}3}$ to close, whereby the line voltage signals $L_{1\text{-}3}$ may energize compressor 104A. Similarly, when energized, the contactor $K_2$ may cause one or more normally open power switches $S_{4\text{-}6}$ to close, whereby the line voltage signals $L_{1\text{-}3}$ may energize compressor 104B.

In some embodiments, temperature sensor 106A may be in the closed position, operatively electrically coupling the power source to the contactor $K_1$ to energize the contactor $K_1$. The energizing of the contactor $K_1$ may cause the line voltage signals $L_{1\text{-}3}$ to be applied to the compressor 104A via the power switches $S_{1\text{-}3}$. Similarly, temperature sensor 106B may be in the closed position, operatively electrically coupling the power source to the contactor $K_2$ to energize the contactor $K_2$. The energizing of the contactor $K_2$ may cause the line voltage signals $L_{1\text{-}3}$ to be applied to compressor 104B via the power switches $S_{4\text{-}6}$.

In an embodiment, temperature sensor 106A may switch to the open position upon sensing a refrigerant temperature above the set point of sensor 106A, as described above. Upon opening, as shown in FIG. 2, temperature sensor 106A may cause de-energizing the contactor $K_1$ which may, in turn, cause de-energizing of compressor 104A as the power switches $S_{1\text{-}3}$ switch to their respective normally-open positions. Similarly, temperature sensor 106B may switch to the open position upon sensing a refrigerant temperature above the set point of the sensor 106B, as described above. Upon opening, as shown in FIG. 2, temperature sensor 106B may cause de-energizing the contactor $K_2$ which may, in turn, cause de-energizing of compressor 104B as the power switches $S_{4-6}$ switch to their respective normally-open positions.

In some embodiments, temperature sensor 106A, as shown in FIG. 2, may switch to the open position without causing de-energizing of compressor 104B while temperature sensor 106B may switch to the open position without causing de-energizing of the compressor 104A. Advantageously, in this configuration, compressors 104A-B may be controlled independently of one another, whereby a detected over-temperature condition of refrigerant discharged from compressor 104A, for example, may cause de-energizing of only the compressor 104A while the compressor 104B may continue to operate, or be energized.

Returning to FIG. 1, in an embodiment, HVAC system 100 may include pressure sensor 108. Pressure sensor 108 may directly sense, calculate, approximate, or determine from sensed data, the refrigerant pressure of HVAC system 100 within the portion of refrigerant piping to which pressure sensor 108 is affixed. Pressure sensor 108 may be operably connected to controller 102 via wired or wireless connections. Pressure sensor 108 may transmit one or more signals comprising sensed pressure data or component status data to controller 102.

In some embodiments, pressure sensor 108 may transmit analog or pneumatic signals either directly, or indirectly, to controller 102. In such an embodiment, the signals transmitted by pressure sensor 108 may be converted to digital signals prior to use by controller 102. In some embodiments, pressure sensor 108 may transmit digital signals to controller 102. In such an embodiment, the digital signals transmitted by pressure sensor 108 may be processed prior to use by controller 102 to convert the signals to a different voltage, to remove interference from the circuits, to amplify the signals, or other similar forms of digital signal processing. In some embodiments, the signals of pressure sensor 108 may be transmitted to controller 102 directly or indirectly, such as through one or more intermediary devices.

According to the embodiment shown in FIG. 1, pressure sensor 108 may sense pressure data of the refrigerant of HVAC system 100 discharged from compressors 104A-B. Pressure sensor 108 may couple to common discharge pipe 109. Pressure sensor 108 may be disposed at a location on common discharge pipe 109 downstream of the respective couplings between discharge pipe legs 107A-B and common discharge pipe 109. Pressure sensor 108 may sense the combined pressure of the refrigerant of HVAC system 100 discharged from the one or more energized compressors 104A-B.

In an embodiment, pressure sensor 108 may be a pressure switch configured to actuate a switching mechanism between open and closed positions in response to sensed refrigerant pressure data. Pressure sensor 108 may be a pressure switch of any type, such as a pneumatic switch, a hydraulic switch, or the like. In an embodiment, pressure sensor 108 may connect to controller 102 via wired or wireless connections to transmit to controller 102 one or more signals indicating the position of pressure sensor 108 switching mechanism.

Pressure sensor 108 may be configured to operate as "high pressure switch," actuating a switching mechanism in response to sensing refrigerant pressure above a defined set point. The set point may define a maximum allowable pressure of the refrigerant of HVAC system 100 discharged by the one or more energized compressors 104A-B. Detection of discharged refrigerant above the set point may indicate unsafe or faulty operation of one or both of the one or more energized compressors 104A-B. Pressure sensor 108 may interrupt one or more power signals, preventing energizing of both of the compressors 104A-B in response to detection of discharge refrigerant pressure above the set point.

In an embodiment, pressure sensor 108 may be configured for normally closed operation. A normally closed pressure switch may remain in the closed position unless and until the sensed pressure of refrigerant rises to above the set point. A normally closed pressure switch may open in response to a sensed pressure value above the set point. A normally closed pressure switch may interrupt one or more power signals when in the open position. In certain embodiments, pressure sensor 108 may be a normally open pressure switch, remaining in the open position unless and until the sensed pressure of refrigerant rises to above the set point. A normally open pressure switch may close in response to a sensed pressure value above the set point to interrupt one or more power signals. In an embodiment, pressure sensor 108 may be further configured to return to the normal switch position in response to sensed refrigerant pressure below a defined reset pressure. The reset pressure may be a preset pressure indicating that the interrupted power signals may be restored, allowing for re-energizing of both compressors 104A-B.

When configured to operate as a high pressure switch, pressure sensor 108 may provide simultaneous protection to both compressors 104A and 104B from over pressure operation. Pressure sensor 108 protects both compressors 104A-B by interrupting power to both compressors 104A and 104B in response to a sensed refrigerant pressure above the set point pressure. In some embodiments, pressure sensor 108, when configured to function as a high pressure switch, may be incapable of discerning which compressor, or compressors, 104A-B caused the over-pressurization of refrigerant within common discharge pipe 109. Pressure sensor 108 may interrupt the one or more power signals energizing each or both of compressors 104A-B, preventing any continued operation of HVAC system 100 to meet a demand on HVAC system 100. Interruption of power to both compressors 104A-B may be undesirable in instances where only a single compressor 104A or 104B from within the tandem compressor group is malfunctioning. Interrupting power to both compressors 104A-B prevents continued operation of the non-faulty compressor (e.g., compressor 104A or 104B), which would be able to at least partially meet a demand on HVAC system 100.

Referring to FIG. 2, pressure sensor 108 may be a normally closed pressure switch. Pressure sensor 108 may electrically couple in series with a power source (24 VAC Common) and temperature sensors 106A-B. Pressure sensor 108 may be interposed between the power source (24 VAC Common) and temperature sensors 106A-B, respectively. Again, the power interrupter circuit embodiment shown in FIG. 2 is provided for illustrative purposes, only, and is not intended to limit the scope of the apparatus and method described, herein. Those of ordinary skill in the art will appreciate that a multitude of circuit configurations and components may be implemented within HVAC system 100 while still providing for pressure sensor 108 functions described, herein and above, to be performed.

As shown in wiring schematic 200, pressure sensor 108 may be in the closed position, operatively electrically coupling the power source to the contactors $K_{1,2}$ to energize the contactor $K_{1,2}$ when respective temperature sensors 106A-B are in the closed position. The energizing of the contactor $K_1$ may cause the line voltage signals $L_{1-3}$ to be applied to compressor 104A via the power switches $S_{1-3}$ while energizing of the contactor $K_2$ may cause the line voltage signals $L_{1-3}$ to be applied to compressor 104B via the power switches $S_{4-6}$.

In an embodiment, pressure sensor 108 may switch to the open position upon sensing a refrigerant pressure above the set point, as described above. Upon opening, as shown in FIG. 2, pressure sensor 108 may cause de-energizing of both the contactors $K_{1,2}$ which may, in turn, cause de-energizing of the compressors 104A-B as the power switches S1-6 switch to their respective normally-open positions. In some embodiments, pressure sensor 108, as configured in FIG. 2, may cause de-energizing of both of compressors 104A-B while pressure sensor 108 in the open position. In this configuration, the compressors 104A-B may not be controlled independently of one another. A detected over-pressure condition of refrigerant discharged from either or both of compressors 104A and/or 104B may cause de-energizing of both of the compressors 104A-B.

In some embodiments, controller 102 may determine that there has been an interruption of power to tandem compressor. This interruption of power may occur when a pressure sensor 108 or temperature sensors 106A-B detected either an over-pressure condition or an over-heated condition of refrigerant associated with either or both of compressors 104A-B. For example, pressure sensor 108 may detect an over-pressure condition, and in response may switch to a position that prevents power from being delivered to the tandem compressor. This may prevent compressor 104A-B of the tandem compressor from operating or being powered on. In some embodiments, controller 102 may determine that there has been an interruption of power to one or more compressors 104A-B by receiving status information indicating the position of a switch, such as the position of pressure switch 108. Controller 102 may also receive status information indicating whether compressors 104A-B are energized or de-energized.

In some embodiments, controller 102 may identify a sensor corresponding to the interruption of power to the tandem compressor. Controller 102 may identify that a temperature sensor, a pressure sensor, or any of the plurality of sensors corresponds to the interruption of power to the tandem compressor. For example, when pressure sensor 108 acts as a pressure switch, controller 102 may receive status information indicating that pressure switch 108 is in an open position that prevents power from being supplied to the tandem compressor. Continuing the example, controller 102 may identify that pressure sensor 108 corresponds to the interruption of power to the tandem compressor.

In some embodiments, controller 102 determines that the interruption of power was caused at least in part by the refrigerant associated with the first compressor exceeding a tolerance condition. A tolerance condition, in some embodiments, may be a pressure set point and/or a temperature set point. For example, temperature sensors 106A-B may determine the temperature of the refrigerant flowing from compressors 104A-B, respectively, and may determine that the temperature exceeds the temperature set point, resulting in an over-heated condition. This over-heated condition may cause temperature sensors 106A-B or controller 102 to interrupt power to one or both compressors 104A-B of the tandem compressor. As another example, pressure sensor 108 may determine the pressure of the refrigerant flowing from compressors 104A-B and may determine that the pressure exceeds the pressure set point, resulting in an over-pressure condition. This over-pressure condition may cause pressure sensor 108 or controller 102 to interrupt power to one or both compressors 104A-B of the tandem compressor.

In some embodiments, controller 102 determines which compressor 104A or 104B is associated with the refrigerant that cause the interruption of power. For example, if pressure sensor 108 determines that the pressure of the refrigerant in common discharge pipe 109 is over a tolerance condition (e.g., there is an over-pressure condition), it prevents power from being supplied to compressors 104A-B. Because pressure sensor 108 is coupled to common piping, it is unclear which compressor 104A or 104B, or other compressors in the tandem compressor, that the over-pressurized refrigerant came from. In order to determine which compressor caused the over-pressure condition, controller 102 may turn on each compressors of the tandem compressor in sequence. For example, controller 102 may turn on compressor 104A. If pressure sensor 108 again detects an over-pressure condition and turns off compressor 104A, then compressor 104A likely caused the first interruption of power. If pressure sensor 108 does not detect an over-pressure condition and power is not interrupted to tandem compressor, then controller 102 may turn off compressor 104A and turn on compressor 104B. While compressor 104B is powered on, controller may wait to determine whether pressure sensor 108 again detects an over-pressure condition. If it does, then compressor 104B likely caused the first interruption of power. By turning on each compressor (e.g., compressors 104A-B) individually and in sequence, controller 102 is able to determine which compressor is causing the over-pressure condition. Although the sequence in the preceding example turns on the first compressor and then the second compressor, other embodiments may use a different sequence.

In some embodiments, controller 102 may reconfigure the tandem compressor. Controller 102 may determine the on or off settings of compressors 104A-B based at least in part on the determination that the first interruption of power was caused at least in part by the refrigerant associated with the first compressor exceeding the tolerance condition. Controller 102 may reconfigure the tandem compressor such that it may continue operation while not powering on the compressor that originally caused the first interruption of power. For example, if controller 102 determines that compressor 104A caused the first interruption of power, controller 102 may power compressor 104A off so that there is less risk of damage or failure to compressor 104A from operating in an over-pressure condition. In some embodiments, controller 102 may determine the on or off settings of compressors 104A-B based at least in part on a required load operation of the tandem compressor. For example, if there is a partial temperature demand on HVAC system 100, controller 102 may still power on compressor 104B that was not responsible for the interruption of power. In this way, HVAC system 100 may continue to satisfy a demand even though one of its compressors (e.g., 104A) cannot function without risk of damage or failure. As another example, if there is a full temperature demand on HVAC system 100, controller 102 may power on compressor 104B that was not responsible for the interruption of power, but controller 102 may power off compressor 104A that was responsible for the interruption of power. In this way, HVAC system 100 lessens the risk of damage or failure to compressor 104A by powering it off, but can work toward satisfying a temperature demand by keeping compressor 104B powered on.

Figure 3:
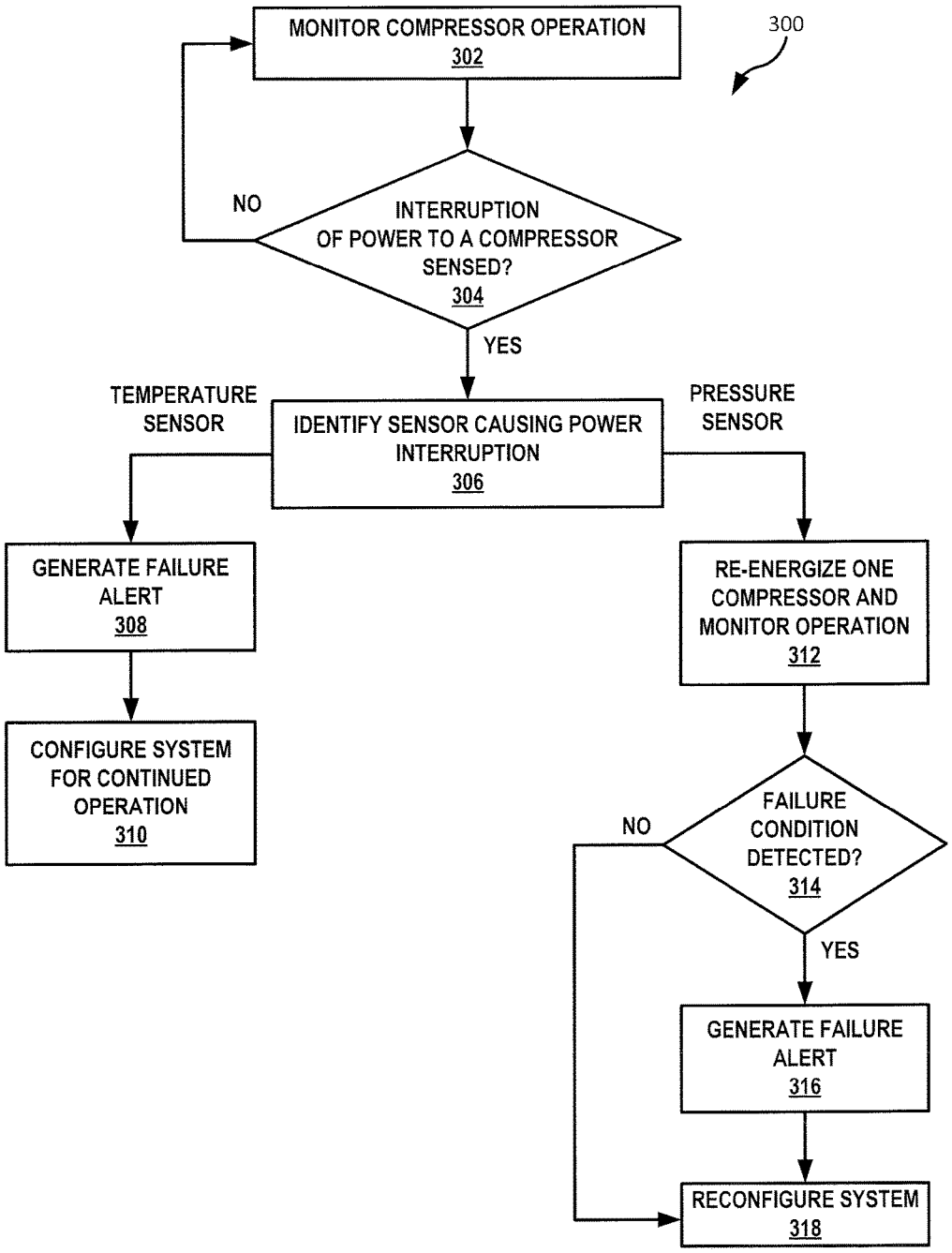
FIG. 3 illustrates a flowchart describing an example of providing tandem compressor discharge pressure and temperature control of HVAC system.

FIG. 3 illustrates a flowchart describing an example of providing tandem compressor discharge pressure and temperature control of HVAC system 100. In certain embodiments, fewer, additional, or different steps may be included than shown in FIG. 3. Additionally, in certain embodiments, the steps of the method 300 may be performed in an order that differs from that shown in FIG. 3. In some embodiments, method 300 may be performed by controller 102. Method 300 may be executed while HVAC system 100 is operating to meet a demand with at least one of the tandem compressors 104A-B energized. Controller 102 may execute method 300 at times when HVAC system 100 is operating in response to either a partial load or full load demand. While operating in response to a full load demand, both of compressors 104A-B may be energized. Conversely, while operating in response to a partial load demand, only one compressor (e.g., 104A or 104B) may be energized.

Controller 102 may monitor the operation of the energized compressor, or compressors, 104A-B at step 302. Controller 102 may monitor the energized compressor, or compressors, 104A-B to verify that the compressor, or compressors, 104A-B energized in response to a current demand on HVAC system 100 remain energized while the current demand persists.

At step 302, in some embodiments, controller 102 may receive one or more signals from the energized compressor, or compressors, 104A-B for use in monitoring the compressor, or compressors, 104A-B. The one or more signals may indicate the current state of the respective compressors 104A-B. For example, controller 102 may receive a separate signal from each of the respective compressors 104A-B indicating whether the compressor 104A-B is currently energized. Additionally, controller 102 may monitor the operation of the energized compressor, or compressors, 104A-B at step 302 through monitoring, or verifying, the respective switch positions of temperature sensors 106A-B and pressure sensor 108. In an embodiment, temperature sensors 106A-B may be normally closed switches configured for operation as high temperature switches, while pressure sensor 108 may be a normally closed switch configured for operation as a high pressure switch. Controller 102 may monitor, or verify, the positions of temperature sensors 106A-B and pressure sensor 108 through generation and transmission of one or more signals. For example, controller 102 may check or verify the respective switch positions of temperature sensors 106A-B and pressure sensor 108 through generation and transmission of one or more signals as part of one or more electrical continuity checks.

In some embodiments, controller 102 may receive one or more signals transmitted by each of temperature sensors 106A-B and pressure sensor 108. The one or more signals received from temperature sensors 106A-B may comprise data indicating one or more refrigerant temperatures. Additionally, the one or more signals received from temperature sensors 106A-B may comprise data indicating the current switch position of temperature sensors 106A-B. The one or more signals received from pressure sensor 108 may comprise of data indicating one or more or pressures sensed by pressure sensor 108. Additionally, the one or more signals received from pressure sensor 108 may comprise data indicating the current switch position of pressure sensor 108.

At step 304, controller 102 may sense that the power applied to the compressor, or compressors, 104A-B in the energized state at step 302 has been interrupted. The interruption of power applied to compressor, or compressors, 104A-B sensed at step 304 may be caused by the opening of one or more of temperature sensors 106A-B and/or pressure sensor 108. The interruption of power may be indicated to controller 102 via a signal from the compressor, or compressors, 104A-B to which power has been interrupted. The interruption of power may be indicated to controller 102 via the discontinuance of reception by controller 102 of a status signal transmitted by each of the respective compressor, or compressors, 104A-B to which power has been interrupted.

In certain embodiments, controller 102 may sense an interruption of power applied to the compressor, or compressors, 104 at step 304 via detection of an "open" in power interrupter circuit 200 via one or more failed continuity checks. In some embodiments, an interruption of power applied to the compressor, or compressors, 104 may be sensed by controller 102 at step 304 following reception of one or more signals transmitted by respective temperature sensors 106A-B and/or pressure sensor 108 indicating that the respective switch is open and/or has sensed an over-temperature or over-pressure condition. If controller 102 does not sense an interruption of power to at least one of compressors 104A-B, controller 102 continues to monitor operation of compressors 104A-B at step 302. If controller 102 sense an interruption of power to at least one of compressors 104A-B, the method continues to step 306.

At step 306, in some embodiments, controller 102 identifies the particular switch causing the interruption of power to one or more compressors 104A-B sensed at step 304, from among temperature sensors 106A-B and pressure sensor 108. Controller 102 may identify the particular switch causing interruption of power using continuity check signals; received signals indicating the position of compressors 104A-B, temperature sensors 106A-B, and/or pressure sensor 108; or one or more received signals indicating one or more temperature or pressure values above one or more tolerance values.

The opening of either or both of temperature sensors 106A-B may indicate an over-temperature condition within HVAC system 100 refrigerant piping. Specifically, the opening of temperature sensor 106A may cause power to compressor 104A to be interrupted and may indicate an over-temperature condition corresponding to compressor 104A. The opening of temperature sensor 106B may cause power to compressor 104B to be interrupted and may indicate an over-temperature condition corresponding to compressor 104B. The opening of pressure sensor 108 may cause power to compressors 104A-B to be interrupted and may indicate an over-pressurization condition, which may correspond to operation of one or both of compressors 104A-B. If controller 102 identifies one or both of temperature sensors 106A-B as causing the interruption of power to at least one of compressors 104A-B at step 306, the method continues to step 308. If controller identifies pressure sensor 108 as causing the interruption of power to at least one of compressors 104A-B at step 306, the method continues to step 312, described further below.

If, at step 306, controller 102 identifies one or both of temperature sensors 106A-B as causing the interruption of power sensed, controller 102 may generate a failure alert at step 308. The failure alert may comprise an audio or visual indicator communicating the compressor, or compressors, 104A-B corresponding to temperature sensor, or sensors 106A-B identified causing the interruption of power sensed to a user of HVAC system 100.

At step 310, controller 102 may reconfigure HVAC system 100 components for continued system operation. Controller 102 may energize, or continue operation of, one of the compressors 104A or 104B, for example, to continue meeting a demand following identification at step 306 of one temperature sensor 106A or 106B as causing the interruption of power. In some embodiments, for example, controller 102 may identify one of temperature sensors 106A or 106B as opening at step 306 and may respond by energizing compressor 104A or 104B that does not correspond to open temperature sensor 106A or 106B. Energizing compressor 104A or 104B not corresponding to the identified open temperature sensor 106A or 106B may allow for continued partial load operation of HVAC system 100 in order to at least partially meet a demand following an interruption of power to only one of compressors 104A-B. In some embodiments, controller 102 may further configure HVAC system 100 for partial load operation using only compressor 104A or 104B not corresponding to the identified open temperature sensor 106A or 106B by adjusting one or more control settings for other HVAC system 100 components, such as a blower, or one or more outdoor fans, or the like.

At step 310, controller 102 may energize, or continue to operate, compressor 104A or 104B not corresponding to identified open temperature sensor 106A or 106B while responding to either a full load or a partial load demand. In some embodiments, if a single temperature sensor 106A or 106B opens during partial load operation of the HVAC system 100, controller 102 may configure HVAC system 100 for confirmed operation at partial load capacity by energizing the non-failing compressor 104A or 104B. HVAC system 100 may continue to meet the partial load demand by energizing one of compressors 104A-B. If a single temperature sensor 106A or 106B opens during full load operation of the HVAC system 100, controller 102 may configure HVAC system 100 for operation at partial load capacity by energizing the non-failing compressor 104A or 104B to at least partially meet the full load demand.

In certain embodiments, controller 102 may maintain compressor 104A or 104B that corresponds to the identified open temperature sensor 106A or 106B in the de-energized state for a defined period of time. The defined period of time may be a time sufficient for temperature sensor 106A to close following an interruption of power detected at step 304. In certain embodiments, the period of time may be a predefined amount of time or may be an indefinite period ending upon cessation of the current demand on HVAC system 100, a user input, or the like. Following execution of step 310, controller 102 may return to step 302 of method 300, monitoring energized compressor 104A-B that was energized at step 310. This continued monitoring at step 302 during continued operation of the HVAC system 100 allows controller 102 to meet the current demand on HVAC system 100.

In some embodiments, method 300 may include only one, and not both, of steps 308 and 310. For example, controller 102 may respond to identification of one or more of temperature sensors 106A-B as causing an interruption of power to one or more compressors 104A-B at step 306 by generating an alert only, and without reconfiguring HVAC system 100 for continued operation at step 310. In some embodiments, controller 102 may respond to identification one or more of temperature sensors 106A-B as causing an interruption of power to one or more compressors 104A-B at step 306 by reconfiguring HVAC system 100 for continued operation at step 310 without generating an alert at step 308. In certain embodiments, step 308 and step 310 may be performed in the opposite order than shown in the embodiment of FIG. 3.

Returning to the discussion of step 306, if at step 306, controller 102 identifies pressure sensor 108 as causing the interruption of power sensed at step 304, the method may proceed to step 312, as further discussed below. Pressure sensor 108 may cause interruption of power to one or both of compressors 104A and/or 104B in response to an over-pressure condition within the refrigerant piping of HVAC system 100. Pressure sensor 108 may remain open for a period of time and may close upon sensing refrigerant pressure below the reset pressure of pressure sensor 108. In certain embodiments, if pressure sensor 108 opens during full load operation of the HVAC system 100, power to both of compressors 104A-B may be interrupted. If pressure sensor 108 opens during partial load operation of the HVAC system 100, power to energized compressor 104A or 104B may be interrupted. Further, energizing of the non-energized compressor 104A or 104B may be prevented by pressure sensor 108 while pressure sensor 108 remains open.

If pressure sensor 108 is identified as causing the interruption of power to the compressor, or compressors, 104A-B at step 306, controller 102 may re-energize one of compressors 104A-B and monitor pressure sensor 108 at step 312. This may allow controller 102 to identify the particular compressor, or compressors, 104A-B causing the over-pressurization condition. Controller 102 may energize a single compressor, for example compressor 104A, following closing of pressure sensor 108. With only compressor 104A energized, controller 102 may individually monitor the operation of compressor 104A for an over-pressure condition using pressure sensor 108. Controller 102 may operate compressor 104A for a period of time while monitoring for over-pressure conditions. If an over-pressure condition is detected at step 314 during operation of single compressor 104A energized at step 312, controller 102 may generate a failure alert at step 316. The failure alert may communicate the detection of an over-pressure condition within HVAC system 100. The failure alert may comprise one or more audio or visual indicators and may identify compressor 104A or 104B corresponding to the identified failure condition. For example, if controller 102 energizes compressor 104A at step 312, and determines an over-pressure condition at step 314, controller 102 determines that compressor 104A is at least partially responsible for the over-pressure condition that originally caused an interruption of power to compressors 104A-B at step 304.

At step 318, in some embodiments, controller 102 may reconfigure HVAC system 100 for further operation. If a failure condition was detected at step 314, controller 102 may reconfigure the HVAC system 100 for continued operation by de-energizing compressor 104A, which may have been energized at the previous execution of step 312. Controller 102 may further reconfigure HVAC system 100 at step 318 by energizing compressor 104B to continue meeting a demand on HVAC system 100 while compressor 104A remains de-energized. In an embodiment, controller 102 may maintain the compressor 104A in the de-energized state for a defined period of time. In an embodiment, the defined period of time may be a time sufficient for the temperature sensor 106A and/or the pressure sensor 108 to close following the failure detected at step 314. In certain embodiments, the period of time may be a predefined amount of time or may be an indefinite period ending upon cessation of the current demand on HVAC system 100, a user input, or the like.

If no over-temperature or over-pressure condition is detected at step 314 during operation of single compressor 104A, which was energized at step 312, then controller 102 may continue to step 318 and may reconfigure HVAC system 100 for further operation. In an embodiment, controller 102 may reconfigure HVAC system 100 at step 318 by de-energizing the currently energized compressor (e.g., compressor 104A), and returning to step 312 to energize compressor 104B. Controller 102 may re-execute steps 312-316 to individually monitor the operation of compressor 104B and pressure sensor 108. For example, if controller 102 energizes compressor 104B at step 312, and determines an over-pressure condition at step 314, then controller 102 determines that compressor 104B is at least partially responsible for the over-pressure condition that originally caused an interruption of power to compressors 104A-B at step 304. In some embodiments, this allows controller 102 to identify the particular compressor 104A and/or 104B causing the failure condition detected at step 304. Upon returning to step 318, controller 102 may configure the HVAC system 100 for continued operation by energizing the non-failing compressor, or compressors, 104A-B in response to the current demand on HVAC system 100. For example, controller 102, through repetition of steps 312-216, may determine that compressor 104B caused the interruption of power at step 304 due to an over-pressure condition, and compressor 104A did not contribute to the over-pressure condition. Continuing the example, controller 102 may de-energize compressor 104B and energize compressor 104A in order to meet the demand on HVAC system 100. Controller 102 may return to step 302 of method 300, resuming monitoring of the energized compressor, or compressors, 104A-B, which may have been energized at step 318.

In some embodiments, if no over-temperature or over-pressure condition is detected at step 314 during operation of single compressor 104A energized at step 312, controller 102 may maintain the HVAC system 100 in its current configuration at step 318 to continue meeting a demand on HVAC system 100. Controller 102 may maintain the HVAC system 100 as configured at step 312 to continue meeting a demand on the HVAC system 100 in instances where the current demand is a partial load demand that may be met through continued operation of only one compressor, for example compressor 104A. In such an embodiment, controller 102 may continue from step 318 to step 302, and resume monitoring the energized compressor 104A during operation of HVAC system 100 to meet the partial load demand in accordance with method 300, as described above.

In an example of operation, controller 102 may implement method 300 as described, herein. HVAC system 100 may include temperature sensor 106A configured to operate as a high temperature switch for monitoring and protecting compressor 104A. HVAC system 100 may be provided with temperature sensor 106B configured to operate as a high temperature switch for monitoring and protecting compressor 104B. HVAC system 100 may be provided with pressure sensor 108 configured to operate as a high pressure switch for monitoring and protecting the compressors 104A and 104B. Controller 102 may commence execution of method 300 as part of full load operation of the HVAC system 100. During full load operation, both of the compressors 104A-B may be energized. Controller 102 may monitor operation of both of the compressors 104A-B at step 302 through continuous continuity checks verifying that that temperature sensors 106A-B and pressure sensor 108 are closed, permitting power to be applied to the respective compressors 104A-B. Controller 102 may sense an interruption of power to the energized compressor 104A at step 304. At step 306, controller 102 may identify, through generation and transmission of one or more continuity check signals, that temperature sensor 106A opened causing the interruption of power to compressor 104A. At step 308, controller 102 may generate an alert displaying a fault code identifying compressor 104A as failing at a display of controller 102. Controller 102 may configure HVAC system 100 at step 310 to continue operation with only compressor 104B energized to partially meet the full load demand on HVAC system 100. Controller 102 may return to step 302 to monitor the continued operation of the compressor 104B.

In another example of operation, controller 102 may commence execution of method 300 during full load operation of HVAC system 100 with both of compressors 104A-B energized. Controller 102 may monitor operation of both of compressors 104A-B at step 302 through continuous continuity checks verifying that that temperature sensors 106A-B and pressure sensor 108 switches are closed, permitting power to be applied to the respective compressors 104A-B. Controller 102 may sense an interruption of power to energized compressors 104A and 104B at step 304. At step 306, controller 102 may identify, through generation and transmission of one or more continuity check signals, that pressure sensor 108 opened in response to an over-pressure condition to interrupt power to compressors 104A-B. Controller 102 may energize compressor 104A at step 312 while compressor 104B is de-energized. Controller 102 may individually monitor operation of compressor 104A using temperature sensor 106A and pressure sensor 108 for a defined period of time. At step 314, controller 102 may determine that no failure condition was detected during the operation of compressor 104A following energizing of compressor 104A at step 312. Controller 102 may reconfigure HVAC system 100 at step 318 to de-energize compressor 104A. Controller 102 may return to step 312 to re-execute steps 312-318 for individually monitoring operation of the compressor 104B. At step 312, controller 102 may energize and monitor compressor 104B. At step 314, controller 102 may sense an interruption of power to energized compressor 104B following energizing of the compressor. Controller 102 may determine that a failure condition corresponding to operation of compressor 104B is detected at step 314. Controller 102 may identify, through generation and transmission of one or more continuity check signals, that temperature sensor 106B opened, causing the interruption of power to compressor 104B during individual operation of the compressor 104B. At step 316, controller 102 may generate an alert displaying a fault code identifying compressor 104B as failing at a display of controller 102. Controller 102 may configure HVAC system 100 at step 318 to continue operation with only compressor 104A energized to partially meet the full load demand on the HVAC system 100. Controller 102 may return to step 302 to monitor the continued operation of compressor 104A.

In the previous discussion, numerous specific details are set forth to provide a thorough understanding of the present disclosure. However, those skilled in the art will appreciate that the present disclosure may be practiced without such specific details. In other instances, well-known elements have been illustrated in schematic or block diagram form in order not to obscure the present disclosure in unnecessary detail. Additionally, for the most part, details concerning well-known features and elements have been omitted inasmuch as such details are not considered necessary to obtain a complete understanding of the present disclosure, and are considered to be within the understanding of persons of ordinary skill in the relevant art.

Having thus described the present disclosure by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present disclosure may be employed without a corresponding use of other features. Many such variations and modi-fications may be considered desirable by those skilled in the art based upon a review of the foregoing description of preferred embodiments.

The invention claimed is:

1. A heating, ventilation, and air-conditioning (HVAC) system, comprising:

a plurality of sensors;

a tandem compressor comprising a first compressor and a second compressor, the tandem compressor operable to compress a refrigerant, the tandem compressor associated with the plurality of sensors;

a controller communicatively coupled to the plurality of sensors and the tandem compressor, the controller operable to:

determine a first interruption of power to the tandem compressor at a first time, the first interruption of power resulting in the first compressor and the second compressing being off;

in response to determining a first interruption of power to the tandem compressor, turn on the first compressor of the tandem compressor at a second time, keeping the second compressor off the second time being after the first time;

monitor whether power to the tandem compressor is interrupted;

determine a second interruption of power at a third time, the third time being after the second time;

in response to determining the second interruption of power at the third time, determine that the first interruption of power was caused at least in part by the refrigerant associated with the first compressor exceeding a tolerance condition;

turn off the first compressor of the tandem compressor at a fourth time, the fourth time being after the third time;

based on a temperature demand, determine that the second compressor of the tandem compressor be turned on; and turn on the second compressor of the tandem compressor.

2. The system of claim 1, wherein to determine that the first interruption of power was caused at least in part by the refrigerant associated with the first compressor exceeding the tolerance condition, the controller is further operable to:

power on the second compressor while the first compressor is powered off; and determine that there is no interruption of power to the tandem compressor in response to powering on the second compressor while the first compressor is powered off.

3. The system of claim 1, wherein the refrigerant associated with the first compressor exceeding the tolerance condition comprises the refrigerant being at a temperature above a set point temperature.

4. The system of claim 1, wherein the refrigerant associated with the first compressor exceeding the tolerance condition comprises the refrigerant being at a pressure above a set point pressure.

5. The system of claim 1, wherein the sensor corresponding to the first interruption comprises a switch configured to change to a position that prevents power from being delivered to the tandem compressor in response to determining that the refrigerant associated with the first compressor exceeds the tolerance condition.

6. The system of claim 1, further comprising:

a first pipe leg coupled to the first compressor, the first pipe leg configured to be in fluid communication with a common pipe;

a second pipe leg coupled to the second compressor, the second pipe leg configured to be in fluid communication with the common pipe;

wherein at least one of the plurality of sensors comprises a switch, the switch coupled to the common pipe and configured to change to a first position that prevents power from being delivered to the tandem compressor and a second position that allows power to be delivered to the tandem compressor; and the controller is further operable to:

in response to determining the first interruption of power to the tandem compressor, determine that the switch is in the first position;

in response to determining that the switch is in the first position:

powering on the first compressor;

determining a second interruption of power to the tandem compressor;

powering off the first compressor;

powering on the second compressor;

determining that there is no interruption of power to the tandem compressor;

in response to determining that there is the second interruption of power to the tandem compressor after powering on the first compressor and that there is no interruption of power to the tandem compressor after powering on the second compressor, determine that the first interruption of power was caused at least in part by the refrigerant associated with the first compressor exceeding the tolerance condition.

7. A controller for operating a heating, ventilation, and air-conditioning (HVAC) system, comprising:

a memory; and a processor communicatively coupled to the memory, the processor operable to:

determine a first interruption of power to a tandem compressor at a first time, the first interruption of power resulting in the first compressor and the second compressing being off, the tandem compressor comprising a first compressor and a second compressor, the tandem compressor operable to compress a refrigerant, the tandem compressor associated with a plurality of sensors;

in response to determining a first interruption of power to the tandem compressor, turn on the first compressor of the tandem compressor at a second time, keeping the second compressor off, the second time being after the first time;

monitor whether power to the tandem compressor is interrupted;

determine a second interruption of power at a third time, the third time being after the second time;

in response to determining the second interruption of power at the third time determine that the first interruption of power was caused at least in part by the refrigerant associated with the first compressor exceeding a tolerance condition;

turn off the first compressor of the tandem compressor at a fourth time, the fourth time being after the third time;

based on a temperature demand, determine that the second compressor of the tandem compressor be turned on; and turn on the second compressor of the tandem compressor.

8. The controller of claim 7, wherein to determine that the first interruption of power was caused at least in part by the refrigerant associated with the first compressor exceeding the tolerance condition, the processor is further operable to:

power on the second compressor while the first compressor is powered off; and determine that there is no interruption of power to the tandem compressor in response to powering on the second compressor while the first compressor is powered off.

9. The controller of claim 7, wherein the refrigerant associated with the first compressor exceeding the tolerance condition comprises the refrigerant being at a temperature above a set point temperature.

10. The controller of claim 7, wherein the refrigerant associated with the first compressor exceeding the tolerance condition comprises the refrigerant being at a pressure above a set point pressure.

11. The controller of claim 7, wherein the processor is operable to determine that the first interruption of power occurred based on the position of a switch in a sensor that monitors the refrigerant associated with the first compressor, wherein the position of the switch prevents power from being delivered to the tandem compressor.

12. The controller of claim 7, wherein the processor is further configured to:

in response to determining the first interruption of power to the tandem compressor, determine that a switch of a sensor is in a first position, the switch coupled to a common pipe, the common pipe in fluid communication with a first pipe leg coupled to the first compressor and a second pipe leg coupled to the second compressor;

in response to determining that the switch is in the first position:

powering on the first compressor;

determining a second interruption of power to the tandem compressor;

powering off the first compressor;

powering on the second compressor;

determining that there is no interruption of power to the tandem compressor;

in response to determining that there is the second interruption of power to the tandem compressor after powering on the first compressor and that there is no interruption of power to the tandem compressor after powering on the second compressor, determine that the first interruption of power was caused at least in part by the refrigerant associated with the first compressor exceeding the tolerance condition.

13. A non-transitory computer readable storage medium comprising instructions, the instructions, when executed by a processor, executable to:

determine a first interruption of power to a tandem compressor at a first time, the first interruption of power resulting in the first compressor and the second compressing being off, the tandem compressor comprising a first compressor and a second compressor, the tandem compressor operable to compress a refrigerant, the tandem compressor associated with a plurality of sensors;

in response to determining a first interruption of power to the tandem compressor, turn on the first compressor of the tandem compressor at a second time, keeping the second compressor off, the second time being after the first time;

monitor whether power to the tandem compressor is interrupted;

determine a second interruption of power at a third time, the third time being after the second time;

in response to determining the second interruption of power at the third time, determine that the first interruption of power was caused at least in part by the refrigerant associated with the first compressor exceeding a tolerance condition;

turn off the first compressor of the tandem compressor at a fourth time, the fourth time being after the third time;

based on a temperature demand, determine that the second compressor of the tandem compressor be turned on; and turn on the second compressor of the tandem compressor.

14. The non-transitory computer readable storage medium of claim 13, wherein to determine that the first interruption of power was caused at least in part by the refrigerant associated with the first compressor exceeding the tolerance condition, the instructions are further executable to:

power on the second compressor while the first compressor is powered off; and determine that there is no interruption of power to the tandem compressor in response to powering on the second compressor while the first compressor is powered off.

15. The non-transitory computer readable storage medium of claim 13, wherein the refrigerant associated with the first compressor exceeding the tolerance condition comprises the refrigerant being at a temperature above a set point temperature.

16. The non-transitory computer readable storage medium of claim 13, wherein the refrigerant associated with the first compressor exceeding the tolerance condition comprises the refrigerant being at a pressure above a set point pressure.

17. The non-transitory computer readable storage medium of claim 13, wherein the instructions are executable to determine that the first interruption of power occurred based on the position of a switch in a sensor that monitors the refrigerant associated with the first compressor, wherein the position of the switch prevents power from being delivered to the tandem compressor.

18. The system of claim 1, the controller further configured to:

in response to determining the second interruption of power at the third time, identify the first compressor of the tandem compressor as a failing compressor;

determine that the second compressor of the tandem compressor is a non-faulty compressor;

generate an alert displaying a fault code that the first compressor of the tandem compressor is the failing compressor, the alert indicating that the first compressor must remain off to prevent damage to the tandem compressor;

generate an alert that the second compressor of the tandem compressor is a non-faulty compressor; and keep the first compressor off for a set period of time.

19. The controller of claim 7, wherein the processor is further configured to:

in response to determining the second interruption of power at the third time, identify the first compressor of the tandem compressor as a failing compressor;

determine that the second compressor of the tandem compressor is a non-faulty compressor;

generate an alert displaying a fault code that the first compressor of the tandem compressor is the failing compressor, the alert indicating that the first compressor must remain off to prevent damage to the tandem compressor;

generate an alert that the second compressor of the tandem compressor is a non-faulty compressor; and keep the first compressor off for a set period of time.

20. The non-transitory computer readable storage medium of claim 13, wherein the instructions are further executable to:

in response to determining the second interruption of power at the third time, identify the first compressor of the tandem compressor as a failing compressor;

determine that the second compressor of the tandem compressor is a non-faulty compressor;

generate an alert displaying a fault code that the first compressor of the tandem compressor is the failing compressor, the alert indicating that the first compressor must remain off to prevent damage to the tandem compressor;

generate an alert that the second compressor of the tandem compressor is a non-faulty compressor; and keep the first compressor off for a set period of time.

* * * * *